US005544768A

United States Patent [19]

Gargione

[11] Patent Number: 5,544,768

[45] Date of Patent: Aug. 13, 1996

[54] CHILD RESISTANT CLOSURE

[75] Inventor: Frank V. Gargione, Egg Harbor, N.J.

[73] Assignee: Comar Inc., Buena, N.J.

[21] Appl. No.: 542,054

[22] Filed: Oct. 12, 1995

[51] Int. Cl.[6] ..... B65D 50/04

[52] U.S. Cl. ..... 215/209; 215/216; 215/221

[58] Field of Search ..... 215/209, 216–221, 215/330, 334, 901

[56] References Cited

U.S. PATENT DOCUMENTS

| | | | |
|---|---|---|---|
| 3,019,931 | 2/1962 | Thornton | 215/221 |
| 3,700,133 | 10/1972 | Bagguley | 215/221 |
| 3,744,655 | 7/1973 | Nixdorff, Jr. | 215/216 |
| 3,881,625 | 5/1975 | Landen | 215/221 |
| 3,884,379 | 5/1975 | Landen | 215/221 |
| 3,892,326 | 7/1975 | Schneible | 215/216 X |
| 3,902,620 | 9/1975 | McIntosh | 215/221 |
| 3,939,788 | 2/1976 | Schneible | 215/216 X |
| 4,011,829 | 3/1977 | Wachsmann et al. | 215/216 X |
| 4,036,385 | 7/1977 | Morris | 215/221 X |
| 4,099,639 | 7/1978 | Boxer et al. | 215/216 X |
| 4,144,983 | 3/1979 | Pauls et al. | 215/216 |
| 4,503,986 | 3/1985 | Nixdorff et al. | 215/330 X |

*Primary Examiner*—Allan N. Shoap
*Assistant Examiner*—Nathan Newhouse
*Attorney, Agent, or Firm*—Brady, O'Boyle & Gates

[57] ABSTRACT

A child resistant closure wherein a ratchet-type cap is threadably mounted on the neck of a container having a ring member integral therewith. A resilient tab having a ratchet tooth thereon is integral with the ring and engageable with ratchet teeth on the cap. The ratchet tooth on the tab and cooperating ratchet teeth on the cap are hidden from view to render the closure more child resistant.

3 Claims, 1 Drawing Sheet

CHILD RESISTANT CLOSURE

BACKGROUND OF THE INVENTION

Various child resistant closures have been proposed wherein a ratchet-type cap is threadably mounted on the neck of a container, and a ratchet tooth on the container neck is engageable with ratchet teeth on the cap, whereby there is an escaping relationship between the ratchet tooth and cap ratchet teeth during the threading of the cap onto the container, and a locking relationship during unthreading of the cap off of the container.

While these child resistant closures have been satisfactory for their intended purposes, they have been characterized by certain disadvantages, such as the cooperating teeth being visible so that a child can easily see the ratchet teeth locking mechanism, and manipulate it to remove the closure from the container. Another disadvantage is in the manufacture of the closure, some of which require three molds with a subsequent assembly operation, and others not being able to be molded because of molding restrictions.

SUMMARY OF THE INVENTION

After considerable research and experimentation, the child resistant closure of the present invention has been devised to overcome the disadvantages experienced with heretofore employed child resistant closures and comprises, essentially, a cylindrical cap having a tap wall and a depending skirt portion having an outwardly flared lower portion terminating in an annular flange portion having continuous inner and outer peripheral wall portions and a bottom wall portion extending radially between the inner and outer peripheral wall portions. A plurality of circumferentially spaced recesses forming ratchet teeth are provided in the bottom wall of the annular flange portion between the inner and outer peripheral wall portions thereof. The cap is adapted to be threaded onto the neck portion of a container having a shoulder portion between the threaded neck portion and body of the container. A ring member is molded integral with the threaded neck portion adjacent the shoulder portion, and a resilient tab member is integral with the ring member and extends substantially tangentially relative thereto. A ratchet tooth is integral with the free end of the tab, extending upwardly therefrom, and receivable into the recesses in an escaping relationship during the threading of the cap onto the container, and in a locking relationship during the unthreading of the cap off of the container. The tab member is adapted to be manually depressed to move the ratchet tooth on the tab out of a respective recess in the cap to thereby unlock the cap for removal from the container. The annular flange portion on the cap is substantially coextensive with the ring member so that the ring member and associated ratchet tooth are positioned between the inner and outer peripheral wall portions of the annular flange portion, whereby the ratchet tooth and associated recesses are hidden from view, while a portion of the tab member is slightly visible by extending beyond the outer periphery of the annular flange portion.

By the construction and arrangement of the child resistant closure of the present invention, the ratchet tooth on the tab member and the ratchet teeth on the cap are hidden from view, to thereby render the closure more child resistant, and which can be more readily manufactured with fewer molding restrictions.

DESCRIPTION OF THE PREFERRED EMBODIMENTS

Figure 1:
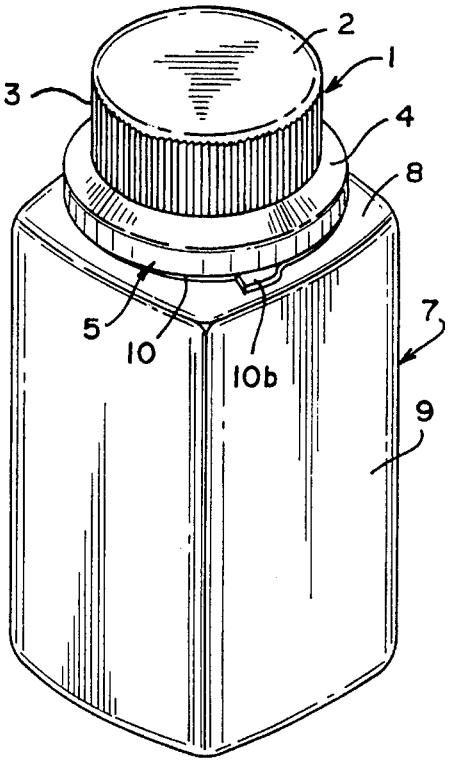
FIG. 1 is a perspective view of a container having the child resistant closure of the present invention mounted thereon.
Figure 2:
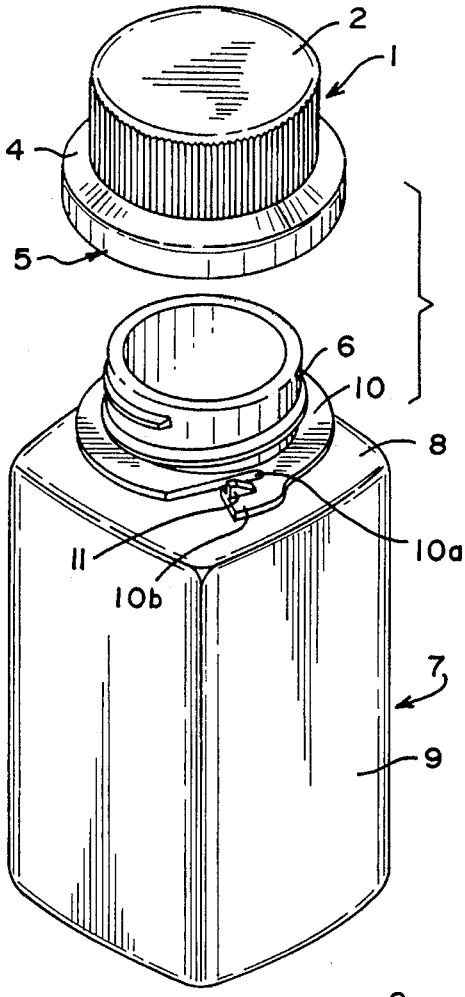
FIG. 2 is a perspective view of the container illustrated in FIG. 1 showing the closure removed therefrom.

Referring to the drawings and, more particularly, to FIGS. 1 and 2, the closure of the present invention comprises a cylindrical cap 1 having a top wall 2 and a depending skirt portion 3 having an outwardly flared lower portion 4 terminating in an annular flange portion 5. The cap 1 is adapted to be threaded onto the neck portion 6 of a container 7 having a shoulder portion 8 between the threaded neck portion 6 and the body 9 of the container 7.

A ring 10 is molded integral with the threaded neck portion 6 adjacent the shoulder portion 8. This ring 10 is provided on many pharmaceutical containers to provide an anchor for the customary shrink wrap which encapsulates the cap 1 when originally packaged, and it also functions as a dust cover to prevent dust from entering the bottom of the cap 1 when threaded onto the container 7. The ring 10 is provided with a semi-chordal slot 10*a* forming a tab member 10*b* extending substantially tangentially to the ring 10, and having a ratchet tooth 11 on the free end thereof extending upwardly therefrom.

Figure 3:
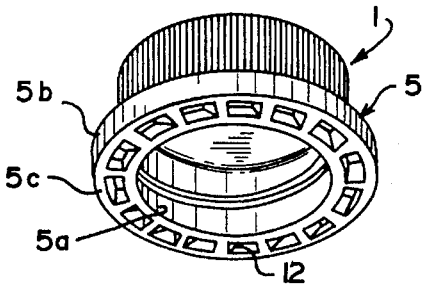
FIG. 3 is a perspective view of the closure of the present invention showing the ratchet teeth provided in the bottom wall of the annular flange portion of the cap.
Figure 4:
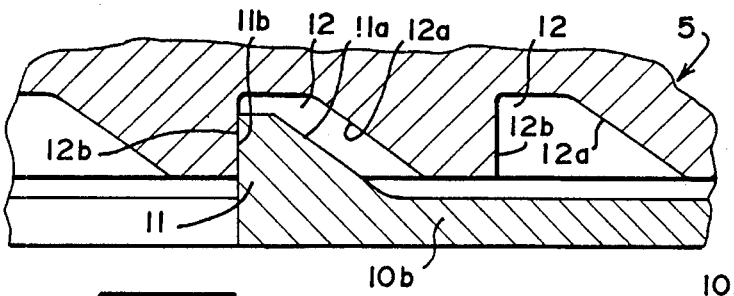
FIG. 4 is an enlarged fragmentary, sectional view showing the ratchet tooth on the tab member engaging one of the ratchet teeth on the cap.
Figure 5:
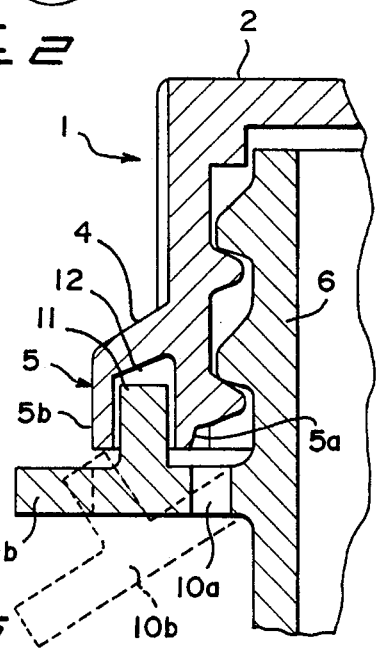
FIG. 5 is an enlarged fragmentary, sectional view illustrating the closure in the locked position on the container, and showing the tab members and associated ratchet tooth, in phantom, being moved to the unlocked position.

As will be seen in FIG. 3, the annular flange portion 5 has a continuous inner peripheral wall 5*a* , a continuous outer peripheral wall 5*b*, and a bottom wall portion 5*c* extending radially between the inner and outer peripheral wall portions 5*a*, 5*b*. A plurality of circumferentially spaced recesses 12 forming ratchet teeth are provided in the bottom wall 5*c* of the annular flange portion 5 between the inner and outer peripheral wall portion 5*a*, 5*b*. When the cap 1 is threaded onto the neck 6 of the container 7, the ratchet tooth 11 is receivable into the recesses 12 in an escaping relationship, and in a locking relationship when the cap 1 is turned in the opposite direction to unthread the cap 1 from the container. To this end, each recess 12 is provided with an inclined wall 12*a* and a vertical wall 12*b* which cooperate, respectively, with a corresponding inclined wall 11*a* and a vertical wall 11*b* on the tab member 10*b* so that in the escaping relationship, the inclined walls 11*a* and 12*a* slide on and relative to each other, and in the locking relationship the vertical walls 11*b* and 12*b* are in abutting relationship, as shown in FIG. 4.

To remove the cap 1 from the container 7, the tab member 10*b* is depressed or pushed downwardly to move the ratchet tooth 11 out of the recess 12; and while the tab member 10*b* is depressed, the cap 1 is unthreaded from the neck portion 6 of the container.

As will be seen in FIG. 1, the annular flange portion 5 on the cap 1 is substantially peripherally coextensive with the ring member 10 so that the ring member 10 and associated ratchet tooth 11 are contained within the inner and outer peripheral walls 5*a*, 5*b* of the flange portion 5, whereby the ratchet tooth 11 and associated recesses 12 are hidden from view; to thereby render the closure more child resistant.

It is to be understood that the forms of the invention herewith shown and described are to be taken as preferred examples of the same, and that various changes in the shape, size, and arrangement of parts may be resorted to, without departing from, the spirit of the invention or scope of the subjoined claims.

I claim:

1. A child resistant closure for a container having a threaded neck portion and a ring member molded integral with the threaded neck portion, a cylindrical cap having a depending skirt portion threadably mounted on said neck portion, a circumferential, outwardly extending collar portion integral with the lower end portion of said skirt, a flange portion on the lower end of said collar portion, said flange portion having continuous inner and outer peripheral wall portions and a continuous, planar, bottom wall portion extending between the inner and outer peripheral wall portions, a plurality of circumferentially spaced recesses forming ratchet teeth contained in said bottom wall between the inner and outer peripheral wall portions of said flange portion, a resilient tab member integral with said ring member and extending substantially tangentially relative thereto, a ratchet tooth integral with the tab extending upwardly in a direction toward said recesses, the ratchet tooth being received in said recesses in an escaping relationship during the threading of the cap onto the container neck and in a locking relationship during the unthreading of the cap from the container neck, said flange portion and said ring member being peripherally coextensive, whereby the ratchet tooth and associated recesses are hidden from view, a portion of said resilient tab extending beyond the periphery of the ring member and manually depressed to move the ratchet tooth on the tab out of a respective recess in the cap to thereby unlock the cap for removal from the container.

2. A child resistant closure according to claim 1, wherein a semi-chordal slot is provided in said ring member to form said tab member.

3. A child resistant closure according to claim 1, wherein the ring member functions as a dust cover to prevent dust from entering the cap when threaded onto the container.

* * * * *